United States Patent [19]

Hollingsead et al.

[11] 3,970,351

[45] July 20, 1976

[54] ELECTRICAL CONNECTOR AND CONTACT STRIP THEREFOR

[75] Inventors: Robert Allen Hollingsead, Yorba Linda; Clyde Robert Pryor, Anaheim, both of Calif.

[73] Assignee: Hollingsead-Pryor Enterprises, Inc., Sante Fe Springs, Calif.

[22] Filed: Dec. 23, 1974

[21] Appl. No.: 535,307

[52] U.S. Cl. ..... 339/49 R; 339/75 M

[51] Int. Cl.[2] ..... H01R 25/04

[58] Field of Search ..... 339/47 R, 49 R, 75 R, 339/75 M, 75 MP, 75 D, 217 S

[56] References Cited

UNITED STATES PATENTS

| | | | |
|---|---|---|---|
| 2,938,190 | 5/1960 | Krehbiel | 339/75 M X |
| 3,145,067 | 8/1964 | Mishelevich et al. | 339/75 M |
| 3,160,459 | 12/1964 | Greco et al. | 339/217 S X |
| 3,324,447 | 6/1967 | Pistey | 339/95 D |
| 3,351,891 | 11/1967 | Schneck | 339/217 S X |
| 3,587,037 | 6/1971 | Anhalt | 339/75 M |
| 3,601,759 | 8/1971 | Barker | 339/75 MP X |
| 3,646,582 | 2/1972 | Van Alphen et al. | 339/95 D |

*Primary Examiner*—Joseph H. McGlynn
*Assistant Examiner*—Howard N. Goldberg
*Attorney, Agent, or Firm*—Jackson & Jones Law Corporation

[57] ABSTRACT

The present invention is directed to a terminal or contact strip for providing electrical contact in a connector shell assembly. The terminal connector strip is pressed from a flat metal blank such as, a copper alloy. The body of the terminal connector strip or pin is bent into a Z-shape or serpentine configuration to enable it to be wedged into an appropriate bore in the shell assembly. The contact head of the connector pin can have a spherical configuration to provide either a mating or point contact with an identical terminal connector pin.

7 Claims, 2 Drawing Figures

ELECTRICAL CONNECTOR AND CONTACT STRIP THEREFOR

BACKGROUND OF THE INVENTION

1. Field of the Invention

The present invention is directed to a terminal connector pin or contact strip and more particularly to a high density terminal connector pin adapted to be utilized in a male-female connector shell assembly.

2. Description of the Prior Art

Terminal connector pins or contacts have been utilized in various sizes and configurations in the prior art. As the density of the pin population has increased in various forms of electrical connectors, both the cost and reliability requirement of the connector pins have increased. For example, it is quite common in the electrical industry to utilize electrical connectors having literally hundreds of pins.

A standard electrical connector pin can be found in the Mishelevich et al U.S. Pat. No. 3,145,067. Generally, the male and female connector pins require spring legs that are capable of being contracted during the insertion of the connector pin into the bore. The spring leg then expands to lock or wedge the connector pin into position. Frequently, the spring leg would cut into the plastic material of the contact shell bore, especially when the connector shell assembly was subject to vibration.

The Walkup U.S. Pat. No. 3,683,317 discloses a minimal insertion force connector wherein a contact strip is deformed to be held within an appropriate recess. The contact strip is designed to receive, with a wiping action, an elongated flat pin.

The Barker U.S. Pat. No. 3,601,759, McIver et al U.S. Pat. No. 3,555,488, Frederick U.S. Pat. No. 3,489,986, and Shlesinger, Jr. U.S. Pat. No. 3,217,284 are cited to disclose various forms of terminal pin connectors.

The problem of providing an easily manufactured and inexpensive terminal pin connector for use in a high density pin electrical connector remains a continual problem. The electrical terminal pin should preferably be easily replaced while at the same time is adaptable to a numerically controlled or automatic wiring machine.

SUMMARY OF THE INVENTION

An electrical contact unit for use in a male or female connector unit includes an elastically deformable contact strip of conductive material having a generally Z-shaped configuration with a pair of substantially parallel sections extending in each direction from an intermediate connecting portion. The contact strip can perform both a male and female function. Each shell of the contact unit has appropriate stops or alignment members for operatively positioning the respective male and female orientation of the single contact strip or terminal pin.

DESCRIPTION OF THE PREFERRED EMBODIMENT

The following description of the invention sets forth the best mode contemplated by the inventors of carrying out their invention.

Figure 1:
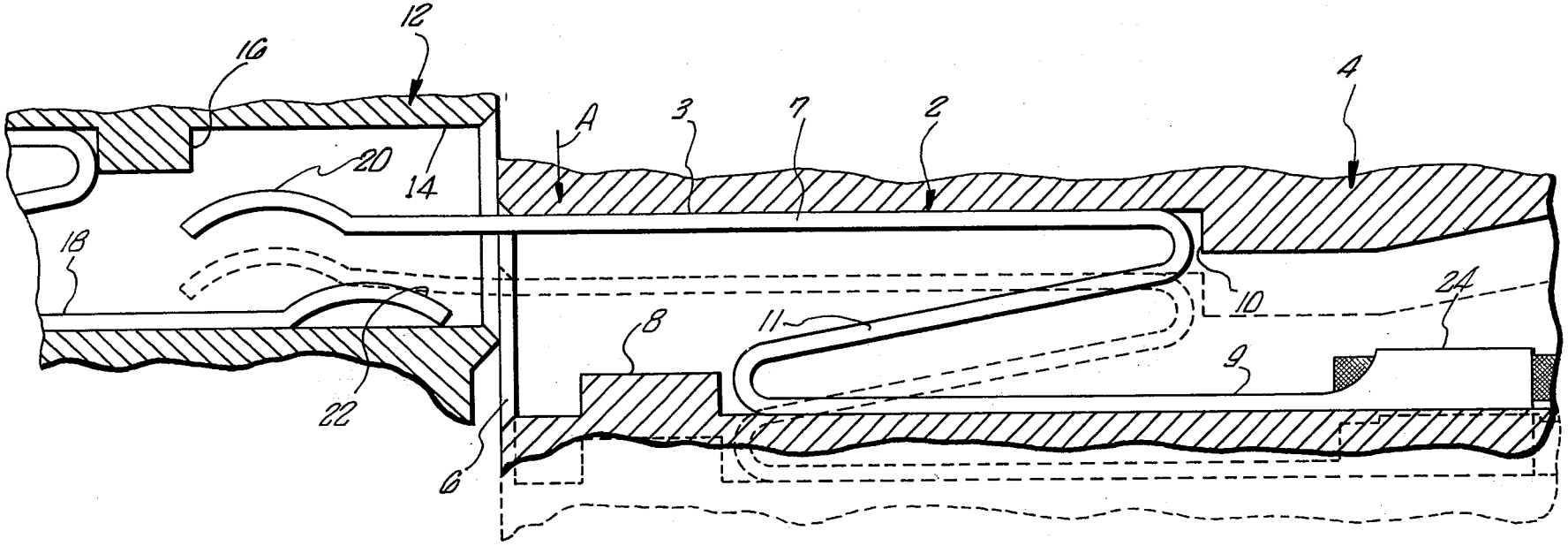
FIG. 1 is a cross-sectional view of the electrical contact strips of the present invention operatively inserted within appropriate bores or slots of an electronical connector unit.

Referring to FIG. 1, a pair of terminal pins or contact strips 2 of the present invention are disclosed in an operative position within an electrical connector unit. The phantom lines of FIG. 1 depict an operative position of a pair of connector shells moved into electrical contact. The arrow, A, discloses the relative movement between the connector shells. The contact strips are mounted within appropriate bores in the respective halves of the pair of connector shells or body members. Basically the contact strips 2 can be made from an elastically deformable band of conductive material, for example, beryllium copper that can be initially cut and shaped on a press and subsequently hardened to provide appropriate springness or elasticity. The terminal pin 2 is bent into a Z-shaped or serpentine configuration for reasons that will be explained subsequently.

Basically, the terminal pin comprises a pair of substantially parallel leg members 7 and 9 that are interconnected by an intermediate portion 11 that extends diagonally between the leg members 7 and 9. The junction of the intermediate portion 11 with each leg is curved preferably in a circular radius to provide a smooth bearing surface to its adjacent bore portion.

For an illustration of a connector shell assembly, reference is made to the Anhalt U.S. Pat. No: 3,587,037 to disclose a relatively high density connector shell assembly.

Referring specifically to FIG. 1, a male connector shell 4 will have an array of longitudinal extending bores or slots 6 adapted to receive the male contact strip or terminal pin 3. Adjacent the entrance of the male connector shell bore 6 is a shoulder or stop member 8 which serves as a forward stop or alignment reference for the contact strip 3. Rearward of the stop member 8 is another stop or shoulder 10 which serves as another alignment reference. The electrical terminal pins or contact strips as depicted in FIG. 1 are in a stressed condition and each of their parallel legs 7 and 9 are biased against the interior wall of their respective bores.

The female connector shell 12 has an appropriately designed mating bore 14. The alignment members, the forward alignment member only being shown as 16 in the drawing, are appropriately positioned to accommodate the insertion of the male terminal pin 3. The female terminal pin 18 is in actuality the same pin as the male termial pin 3. However, it is held in a mirror image position, as shown in FIG. 1, when assembled in a connector shell.

Figure 2:
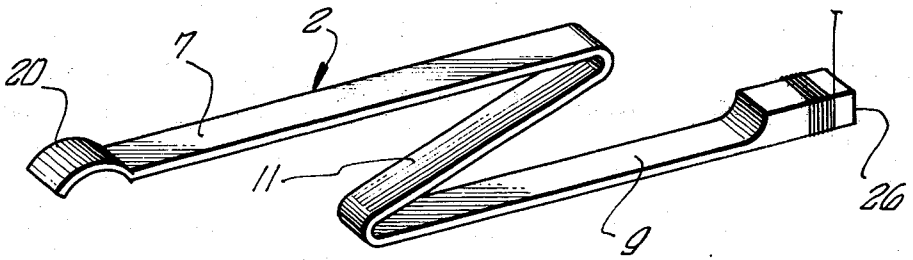
FIG. 2 is a perspective view of the contact strip of the present invention.

The contact head of both the male and female contact strips or pins 3 and 8 have a semi-spherical configuration that can be best seen in FIG. 2. The actual contact point on the male terminal pin 3 is adjacent the elbow or junction of the male head portion 20 with the leg portion 7. This contact area provides a point contact with the convex surface of the female connector head 22. If desired, the contact point on the male head 20 can be completely or partially coated in gold, platinum or silver to decrease electrical resistance.

The wire connecting end of each of the terminal pin 2 can be advantageously formed into any one of a number of desirable shapes. For example, in FIG. 1, the band of metal is bent into the form of a conical conduit 24, and is adapted to receive a wire and then to be subsequently crimped to insure electrical connection.

Referring to FIG. 2, an alternative embodiment is disclosed wherein the wire receiving end forms a post or block 26 which is adapted to receive tightly wound wire that is generally installed by a numerically controlled automatic wire wrapping machine.

As may be appreciated by those skilled in the art, various modifications can be effectuated within the parameters of the present invention. For example, the head of the terminal pin can have a hole punched in the middle or be modified to assume other geometrical configurations, as long as it assures definite electrical contact. Likewise, the bores of the respective male and female connector shells 4 and 12 are only schematically shown, and may be modified in actual practice to facilitate the adaption of the present invention to a particular use of a connector shell.

The present invention is particularly designed to provide a relatively inexpensive terminal pin or contact strip that can interchangeably serve as both a male and female contact in a connector shell assembly. The rounded corners or junctions of spring-biased legs of the terminal pin readily adapts itself to a positive seating within an appropriate bore or slot without any cutting of the plastic material of the bore.

By the insertion of an appropriate blade or wedge-shaped object, e.g., a small screw driver to depress the parallel legs sufficiently against their spring bias to permit passage of the terminal pin through the appropriate alignment member or stop, it is possible to remove any defective terminal pin. Thus, it is possible for the terminal pin of the present invention to be quickly removed from an array of bores by the appropriate depression or contraction of the pin upon itself and the exertion of a simple force.

From an assembly viewpoint, an array of terminal pins having respective wire receiving posts 26 can be inserted into a connector shell, appropriately positioned within a numerically controlled wiring machine and then appropriate wires can be connected thereto. If one of the terminal pins or wires fail in operation, it is possible to easily remove the failed terminal pin with another terminal pin having an identical configuration but with a crimp end 24 as shown in FIG. 1. Thus, a simple repair can be made in the field while still permitting automatic manufacture of the connector shell assembly. In addition, the particular construction of the Z-shaped spring legs of the terminal pin is adapted to minimize any vibrational problems that may be experienced, for example in an aircraft application.

As can be readily appreciated, it is possible to deviate from the above embodiments of the present invention and it will be readily understood by those skilled in the art that the invention is capable of many modifications and improvements within the scope and spirit thereof. Accordingly, it will be understood that the invention is not to be limited by the specific disclosed embodiment but only by the scope and spirit of the appended claims.

What is claimed is:

1. An electrical connector assembly comprising: a male and female connector body member, each of the body members having a plurality of longitudinally bores therethrough extending from a front face to a rear portion thereof and movable traverse to the axis of their longitudinal bores;

an identical elastically deformable contact strip of a solid flat conductive material positioned within at least one bore in each of the male and female body members, the contact strip being formed generally in a Z-shape and consisting of a diagonally intermediate section and a pair of parallel leg sections extending in each direction from the diagonal intermediate section, the respective parallel leg sections are connected to the intermediate section by curved bends, and one end of each leg section terminates in a contact portion, the contact strips are contracted during insertion into the respective bores;

first stop means located within the bores in each male body member to position the contact strip therein with a contact portion of the strip extending beyond the face of the body member and to prevent longitudinal movement of the contact strip in each direction within the bore when the contact strip is in its expanded condition, the respective parallel leg sections extending along opposite surfaces of the male bore with the diagonal intermediate section extending between the parallel leg sections and across the bore; and second stop means located within the bores in each female body member to position the contact strip therein so that the leg section extending forward towards the face of the female body member and its contact portion remains within the respective bore and prevents longitudinal movement of the contact strip within the bore when the contact strip is in its expanded condition, the respective parallel leg sections extending along the opposite surfaces of the female bore with the diagonal intermediate section extending between the parallel leg sections and across the bore.

2. The contact as defined in claim 1 wherein one of the leg sections defines a post for receiving a wrapped wire.

3. The contact as defined in claim 1 wherein one of the leg sections defines a collapsable hollow end adapted to be crimped onto a wire.

4. The contact as defined in claim 1 wherein each of the leg portions includes a curved contact cylindrical section portion on the end thereof.

5. The contact as defined in claim 1 wherein the material is beryllium copper.

6. The combination as defined in claim 1 wherein the stop means are arranged to permit the insertion and removal of the contact strip from a bore when the leg sections of the contact strip are compressed towards each other.

7. An electrical connector assembly comprising: a male and female connector body member, each of the body members having a plurality of longitudinally bores therethrough extending from a front face to a rear portion thereof and movable traverse to the axis of their longitudinal bores;

an identical elastically deformable contact strip of a conductive material positioned within at least one slot in each of the male and female body members, the contact strip being formed generally in a Z-shape and comprising a diagonal intermediate section and a pair of leg sections extending in each direction from the diagonal intermediate section, the respective leg sections are connected to the intermediate section with one end of each leg section terminating in a contact portion, the contact strips being contracted during insertion into the respective bores;

first stop means located within the bores in each male body member to position the contact strip therein with a contact portion of the strip extending beyond the face of the body member and to prevent longitudinal movement of the contact strip in each direction within the bore when the contact strip is in its expanded condition, the respective leg sections extending along opposite surfaces of the male bore with the diagonal intermediate section extending between the leg sections and across the bore; and second stop means located within the bores in each female body member to position the contact strip therein so that the leg section extending forward towards the face of the female body member and its contact portion remains within the respective bore and prevents longitudinal movement of the contact strip within the bore when the contact strip is in its expanded condition, the respective leg sections extending along the opposite surfaces of the female bore with the diagonal intermediate section extending between the leg sections and across the bore.

* * * * *